US008921779B2

(12) United States Patent
Grothe, Jr.

(10) Patent No.: US 8,921,779 B2
(45) Date of Patent: Dec. 30, 2014

(54) EXPONENTIAL SCAN MODE FOR QUADRUPOLE MASS SPECTROMETERS TO GENERATE SUPER-RESOLVED MASS SPECTRA

(71) Applicant: Thermo Finnigan LLC, San Jose, CA (US)

(72) Inventor: Robert A. Grothe, Jr., Campbell, CA (US)

(73) Assignee: Thermo Finnigan LLC, San Jose, CA (US)

( * ) Notice: Subject to any disclaimer, the term of this patent is extended or adjusted under 35 U.S.C. 154(b) by 0 days.

(21) Appl. No.: 14/014,844

(22) Filed: Aug. 30, 2013

(65) Prior Publication Data

US 2014/0151544 A1 Jun. 5, 2014

Related U.S. Application Data

(60) Provisional application No. 61/732,110, filed on Nov. 30, 2012.

(51) Int. Cl.
*H01J 49/42* (2006.01)
*H01J 49/00* (2006.01)

(52) U.S. Cl.
CPC ..... *H01J 49/4225* (2013.01); *H01J 49/0031* (2013.01); *H01J 49/429* (2013.01); *H01J 49/4215* (2013.01)
USPC ..... 250/290; 250/282; 250/292; 250/293

(58) Field of Classification Search
CPC . H01J 49/0031; H01J 49/4215; H01J 49/429; H01J 49/0036
USPC ..... 250/282, 290, 292, 293
See application file for complete search history.

(56) References Cited

U.S. PATENT DOCUMENTS

| | | | | |
|---|---|---|---|---|
| 3,515,869 | A * | 6/1970 | Delany et al. | 250/298 |
| 3,920,985 | A * | 11/1975 | Hiller et al. | 250/281 |
| 4,810,882 | A | 3/1989 | Bateman | |
| 5,436,445 | A * | 7/1995 | Kelley et al. | 250/282 |
| 5,468,957 | A * | 11/1995 | Franzen | 250/282 |
| 5,644,128 | A | 7/1997 | Wollnik et al. | |
| 6,410,913 | B1 * | 6/2002 | Brekenfeld et al. | 250/282 |
| 6,661,013 | B2 | 12/2003 | Jagutzki et al. | |
| 6,730,903 | B2 * | 5/2004 | Kawato | 250/292 |
| 7,019,307 | B1 | 3/2006 | Gribb et al. | |
| 7,087,897 | B2 * | 8/2006 | Bateman et al. | 250/287 |
| 7,339,521 | B2 | 3/2008 | Scheidemann et al. | |

(Continued)

*Primary Examiner* — Michael Logie
*Assistant Examiner* — Wyatt Stoffa
(74) *Attorney, Agent, or Firm* — Charles B. Katz; Michael C. Staggs

(57) ABSTRACT

A novel scanning method of a mass spectrometer apparatus is introduced so as to relate by simple time shifts, rather than time dilations, the component signal ("peak") from each ion even to an arbitrary reference signal produced by a desired homogeneous population of ions. Such a method and system, as introduced herein, is enabled in a novel fashion by scanning exponentially the RF and DC voltages on a quadrupole mass filter versus time while maintaining the RF and DC in constant proportion to each other. In such a novel mode of operation, ion intensity as a function of time is the convolution of a fixed peak shape response with the underlying (unknown) distribution of discrete mass-to-charge ratios (mass spectrum). As a result, the mass distribution can be reconstructed by deconvolution, producing a mass spectrum with enhanced sensitivity and mass resolving power.

12 Claims, 3 Drawing Sheets

(56) References Cited

U.S. PATENT DOCUMENTS

| | | | | |
|---|---|---|---|---|
| 7,470,901 | B2 | 12/2008 | Page et al. | |
| 2004/0031920 | A1* | 2/2004 | Giles et al. | 250/287 |
| 2004/0206899 | A1* | 10/2004 | Webb et al. | 250/281 |
| 2007/0023638 | A1* | 2/2007 | Bateman et al. | 250/287 |
| 2010/0320377 | A1* | 12/2010 | Cotter et al. | 250/283 |
| 2011/0062325 | A1* | 3/2011 | Mukaibatake | 250/288 |
| 2011/0215235 | A1* | 9/2011 | Schoen et al. | 250/282 |
| 2011/0315866 | A1* | 12/2011 | Mitchell et al. | 250/282 |
| 2012/0112056 | A1* | 5/2012 | Brucker et al. | 250/290 |

* cited by examiner

EXPONENTIAL SCAN MODE FOR QUADRUPOLE MASS SPECTROMETERS TO GENERATE SUPER-RESOLVED MASS SPECTRA

BACKGROUND OF THE INVENTION

1. Field of the Invention

The present invention relates to the field of mass spectrometry. More particularly, the present invention relates to a mass spectrometer system and method that provides for an improved mode of operation of a quadrupole mass spectrometer that includes scanning the RF and DC applied fields exponentially versus time while maintaining the RF and DC in constant proportion to each other. In this novel mode of operation, ion intensity as a function of time is the convolution of a fixed peak shape response with the underlying (unknown) distribution of discrete mass-to-charge ratios (mass spectrum). As a result, the mass distribution can be reconstructed by deconvolution, producing a mass spectrum with enhanced sensitivity and mass resolving power.

2. Discussion of the Related Art

Quadrupoles are conventionally described as low-resolution instruments. The theory and operation of conventional quadrupole mass spectrometers is described in numerous text books (e.g., Dawson P. H. (1976), *Quadrupole Mass Spectrometry and Its Applications*, Elsevier, Amsterdam), and in numerous Patents, such as, U.S. Pat. No. 2,939,952, entitled "Apparatus For Separating Charged Particles Of Different Specific Charges," to Paul et al, filed Dec. 21, 1954, issued Jun. 7, 1960.

As a mass filter, such instruments operate by setting stability limits via applied RF and DC potentials that are capable of being linearly ramped as a function of time such that ions with a specific range of mass-to-charge ratios have stable trajectories throughout the device. In particular, by applying fixed and/or ramped AC and DC voltages to configured cylindrical but more often hyperbolic electrode rod pairs in a manner known to those skilled in the art, desired electrical fields are set-up to stabilize the motion of predetermined ions in the x and y directions. As a result, the applied electrical field in the x-axis stabilizes the trajectory of heavier ions, whereas the lighter ions have unstable trajectories. By contrast, the electrical field in the y-axis stabilizes the trajectories of lighter ions, whereas the heavier ions have unstable trajectories. In combination, the electrical field in both axes determines the band pass mass filtering action of a particular quadrupole mass filter to extract desired mass data. Upon detection of such data, a deconvolution software algorithm(s) is often utilized to filter the resultant quadrupole mass spectral data in order to improve the mass resolution.

Typically, quadrupole mass spectrometry systems employ a single detector to record the arrival of ions at the exit cross section of the quadrupole rod set as a function of time. By varying the mass stability limits monotonically in time, the mass-to-charge ratio of an ion can be (approximately) determined from its arrival time at the detector. In a conventional quadrupole mass spectrometer, the uncertainty in estimating of the mass-to-charge ratio from its arrival time corresponds to the width between the mass stability limits. This uncertainty can be reduced by narrowing the mass stability limits, i.e. operating the quadrupole as a narrow-band filter. In this mode, the mass resolving power of the quadrupole is enhanced as ions outside the narrow band of "stable" masses crash into the rods rather than passing through to the detector. However, the improved mass resolving power comes at the expense of sensitivity. In particular, when the stability limits are narrow, even "stable" masses are only marginally stable, and thus, only a relatively small fraction of these reach the detector.

Background information on a system that is directed to addressing the improvement of the resolving power of a quadrupole mass filter while simultaneously increasing the sensitivity is described in U.S. Ser. No. 12/716,138 entitled: "A QUADRUPOLE MASS SPECTROMETER WITH ENHANCED SENSITIVITY AND MASS RESOLVING POWER," to Schoen et al, the disclosure of which is hereby incorporated by reference in its entirety.

In general, the system as disclosed in U.S. Ser. No. 12/716,138 utilizes a detection scheme and method of processing the data (a stream of images, i.e., Qstream™) after acquisition to result in a desired high sensitivity and high resolution spectra. The principal idea behind the embodiments described in U.S. Ser. No. 12/716,138 is that one can measure a set of images produced by any one homogeneous population of ions to form a "reference signal". Then, in a mixture of arbitrary ions, one can write the observed signals as the superposition of individual components, which are scaled versions of the measured reference signal. The scaling is vertical, to address abundance differences and horizontal, to address difference in mass-to-charge ratios. When the mass range and mass stability limits are a small fraction of the ion mass, the dilation of the reference signal can be approximated by a shift. In the case where component signals are shifted replicates of the reference signal, the observed data can be modeled as the convolution between a mass spectrum (comprising of scaled impulses at discrete mass positions) and the reference signal. In this special case, the mass spectrum can be reconstructed by rapid deconvolution. When the component signals are, in fact, related by dilation rather than shift, deconvolution provides an approximate solution, whose accuracy reflects the extent to which replacing time-dilations with time-shifts is valid. Because the accuracy of the approximation decreases with the width of the mass stability limit, relatively narrow limits are required, limiting ion duty cycle and therefore sensitivity. Because the accuracy of the approximation decreases with the width of the mass range linked to a given reference signal, it is necessary to employ multiple reference signals that would, ideally, be separated at regular mass intervals. Acquired data covering a large mass range could be partitioned into small "chunks" centered around a reference signal. For sufficiently small chunks, the application of deconvolution would provide an accurate result for each chunk. The mass spectrum could be "stitched" together from the analysis of the chunks. This "chunking" mode of operation involves additional complexity in calibration and analysis, and gives only a moderately accurate, but suboptimal, result.

Accordingly, there is a need in the field of mass spectroscopy to provide a system and method that can acquire data which is the convolution of the desired mass spectrum with a fixed response function (i.e., reference signal). That is, the component signals from distinct ion populations that are related to an acquired reference signal by simple time shifts, rather than time dilations. Such embodiments, as introduced herein, are enabled in a novel fashion by scanning the RF and DC on a quadrupole mass filter exponentially versus time and with a constant RF/DC proportion. The result provides high mass resolving power at high sensitivity spectra that is clearly distinguished from that produced by conventional quadrupole mass spectrometry methods and systems.

SUMMARY OF THE INVENTION

A first aspect of the present invention is directed to a mass spectrometer instrument that includes the following components: 1) a quadrupole configured so that exponentially ramped oscillatory (RF) and direct current (DC) voltages can be applied to the set of electrodes of the device, wherein the (RF) and (DC) voltages are applied exponentially versus time and maintained in constant proportion to each other during the progression of ramping thus enabling the quadrupole to selectively transmit to its distal end an abundance of ions within a range of mass-to-charge values (m/z's) determined by the amplitudes of the applied voltages: 2) a detector configured adjacent to the distal end of the quadrupole to acquire a series of the abundance of ions during the progression of the applied exponential ramped oscillatory and direct current (DC) voltages; and 3) a processor coupled to the detector and configured to subject the acquired series of the abundance of ions to deconvolution as a function of the applied exponential RF and/or DC fields so as to provide a mass spectrum.

Another aspect of the present invention provides for a deconvolution mass spectrometry method that includes: measuring by way of a quadrupole, a reference signal representative of a measured or expected time distribution and/or time and spatial distribution of a single ion species while time-varying RF and DC voltages are applied to the quadrupole; applying an exponentially ramped oscillatory (RF) voltage and an exponentially ramped direct current (DC) voltage to the quadrupole, wherein said RF and DC voltages are maintained in constant proportion to each during the progression of ramping so as to selectively transmit to the distal end of the quadrupole an abundance of ions to be measured within a range of mass-to-charge values (m/z's) determined by the amplitudes of the applied RF and DC voltages; acquiring temporal or both temporal and spatial measurements of the abundance of ions from the distal end of the quadrupole; reconstructing a mass spectrum by deconvolving the reference signal from the acquired ion measurements, thus providing estimates of ion abundance at regular time intervals; transforming the time points where estimates were provided into mass-to-charge ratios, thereby forming a (sampled) mass spectrum; and reconstructing a list of distinct m/z values and estimated intensities from the deconvolved mass spectrum.

Accordingly, the present invention provides for a novel RF and/or DC exponential ramped method of operation and corresponding apparatus/system that enables a user to acquire comprehensive mass data with a time resolution on the order of about an RF cycle by computing the distribution of the ion density as a function of time and/or as a function of time and position in the cross section at a quadrupole exit. Applications include, but are not strictly limited to: petroleum analysis, drug analysis, phosphopeptide analysis, DNA and protein sequencing, etc. that hereinbefore were not capable of being interrogated with quadrupole systems. The method of operation described herein enhances the performance of the mass spectrometer with very little additional hardware cost or complexity. Alternatively, one could relax requirements on the manufacturing tolerances to reduce overall cost while improving robustness and maintaining system performance.

DETAILED DESCRIPTION

Figure 1:
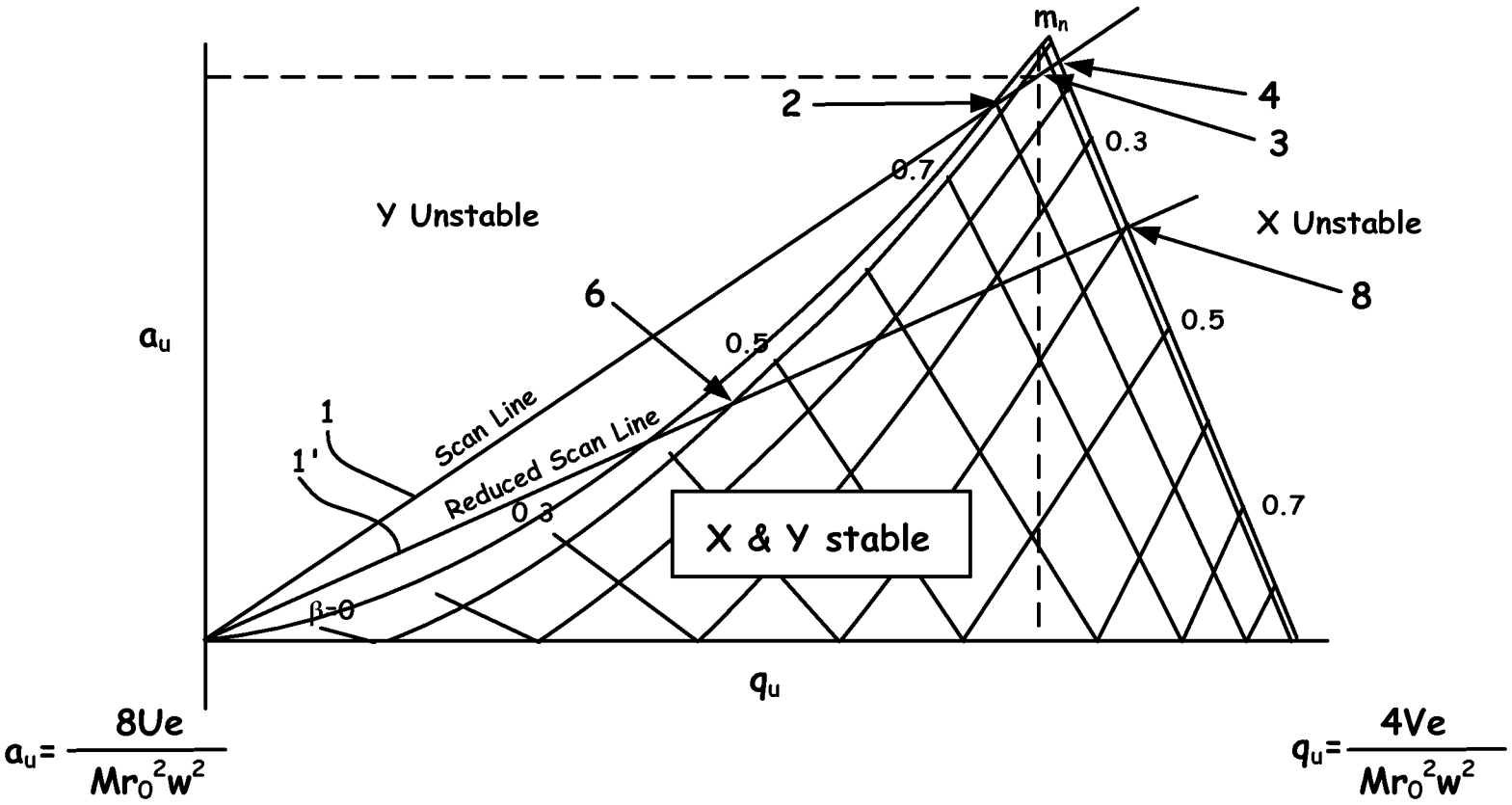
FIG. 1 shows the Mathieu stability diagram with a scan line representing narrower mass stability limits and a "reduced" scan line, in which the DC/RF ratio has been reduced to provide wider mass stability limits and enhanced ion transmission.

In the description of the invention herein, it is understood that a word appearing in the singular encompasses its plural counterpart, and a word appearing in the plural encompasses its singular counterpart, unless implicitly or explicitly understood or stated otherwise. Furthermore, it is understood that for any given component or embodiment described herein, any of the possible candidates or alternatives listed for that component may generally be used individually or in combination with one another, unless implicitly or explicitly understood or stated otherwise. Moreover, it is to be appreciated that the figures, as shown herein, are not necessarily drawn to scale, wherein some of the elements may be drawn merely for clarity of the invention. Also, reference numerals may be repeated among the various figures to show corresponding or analogous elements. Additionally, it will be understood that any list of such candidates or alternatives is merely illustrative, not limiting, unless implicitly or explicitly understood or stated otherwise. In addition, unless otherwise indicated, numbers expressing quantities of ingredients, constituents, reaction conditions and so forth used in the specification and claims are to be understood as being modified by the term "about."

Accordingly, unless indicated to the contrary, the numerical parameters set forth in the specification and attached claims are approximations that may vary depending upon the desired properties sought to be obtained by the subject matter presented herein. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the subject matter presented herein are approximations, the numerical values set forth in the specific examples are reported as precisely as possible. Any numerical values, however, inherently contain certain errors necessarily resulting from the standard deviation found in their respective testing measurements.

General Description

Conventional wisdom states that a quadrupole mass spectrometer is desirably scanned linearly (i.e. RF amplitude is a linear function of time), while magnetic sector instruments are often scanned exponentially. In the present application, exponential scanning of the RF and DC fields as function of time is claimed as a beneficial mode of operation for quadrupole-based mass spectrometers, such as, but not limited to, conventional quadrupole mass filters, quadrupole ion traps, and QStream™, an ion-imaging, super-resolving quadrupole mass spectrometer currently in development, as similarly described in aforementioned Application U.S. Ser. No. 12/716,138 entitled: "A QUADRUPOLE MASS SPECTROMETER WITH ENHANCED SENSITIVITY AND MASS RESOLVING POWER," the disclosure of which is hereby incorporated by reference in its entirety.

As known to those skilled in the art, the Mathieu equation describes the motion of ions and thus operation of quadrupole-based mass spectrometers. The solution of the Mathieu equation states that the trajectory of an ion in a quadrupole is determined by the unitless Mathieu a and q parameters, the initial RF phase of the ion as it enters the quadrupole, and the initial position and velocity of the ion. Such solutions are often classified as bounded and non-bounded. Bounded solutions correspond to trajectories that never leave a cylinder of finite radius. Typically, bounded solutions are equated with trajectories that carry the ion along the length of the quadrupole to the detector. Because the field is generated by rods with finite length and finite transaxial separation, theoretical stability and actual transmission of ions are not precisely related. For example, some ions with bounded trajectories hit the rods rather than passing through to the detector, i.e., the bound radius exceeds the radius of the quadrupole orifice. Conversely, some ions with marginally unbounded trajectories pass through the quadrupole to the detector, i.e., the ion reaches the detector before its trajectory has a chance to expand radially out to infinity.

If m/z denotes the ion's mass-to-charge ratio, U denotes the DC offset, and V denotes the RF amplitude, then the Mathieu parameter a is proportional to U/(m/z) and the Mathieu parameter q is proportional to V/(m/z). The plane of (q, a) values can be partitioned into contiguous regions corresponding to bounded solutions and unbounded solutions. The depiction of the bounded and unbounded regions in the q-a plane is called a stability diagram. The region containing bounded solutions of the Mathieu equation is called a stability region. A stability region is formed by the intersection of two regions, corresponding to regions where the x- and y-components of the trajectory are stable respectively. There are multiple stability regions, but conventional instruments involve the principal stability region. The principal stability region has a vertex at the origin of the q-a plane. Its boundary rises monotonically to an apex at a point with approximate coordinates (0.706, 0.237) and falls monotonically to form a third vertex on the a-axis at q approximately 0.908. By convention, only the positive quadrant of the q-a plane is considered. In this quadrant, the stability region resembles a triangle whose base is the (horizontal) q-axis.

FIG. 1 shows such an example Mathieu quadrupole stability diagram for ions of a particular mass/charge ratio. For an ion to pass, it must be stable in both the X and Y dimensions simultaneously. When the quadrupole is operated as a mass filter, the values of U and V are fixed. The values of U and V can be desirably chosen to place a selected mass $m_n$ close to the apex of in the diagram so that substantially only ions of mass $m_n$ can be transmitted and detected. In this case, the mass resolving power of the quadrupole filter is high, but at the expense of low transmission. For fixed values of U and V, ions with different m/z values map onto a line in the stability diagram passing through the origin and a second point (q*,a*) (denoted by the reference character 2). The set of values, called the operating line, as denoted by the reference character 1 shown in FIG. 1, can be denoted by {(kq*, ka*): k>0), with k inversely proportional to m/z. The slope of the line is equal to the 2U/V. When U and V start at zero and increase as a function of time while maintaining a constant U/V ratio, the same operating line described above also describes the set of (q,a) values traversed by each ion over time. When the RF and DC voltages are ramped linearly as a function of time, the U/V ratio remains constant, ("scanned" as stated above) and each ion moving along the operating line at a rate that is constant over time and inversely proportional to the ion's mass-to-charge ratio m/z.

Therefore, the instrument, using the stability diagram as a guide can be "parked", i.e., operated with a fixed U and V to target a particular ion of interest, (e.g., at the apex of FIG. 1 as denoted by m) or "scanned", increasing both U and V amplitude monotonically to bring the entire range of m/z values into the stability region at successive time intervals, from low m/z to high m/z.

To provide increased sensitivity by increasing the abundance of ions reaching the detector, a scan line 1', as shown in FIG. 1, can be reconfigured with a reduced slope, as bounded by the regions 6 and 8. Because a longer segment of operating line 1' lies within the stability region, a wider range of mass values are admitted by the quadrupole filter, resulting in reducing mass resolving power. In addition, moving away from the apex increases ion transmission by increasing the fraction of "stable" ions that actually reach the detector. When the quadrupole is scanned, carrying ions along operating line 1', observed peaks in the mass spectrum are not only taller because of the increased transmission described above, but also wider because each ion spends a longer fraction of time inside the stability region. Note that increase in the total number of ions that reach the detector when the operating line is moved from 1 to 1' is increased by the multiplicative product of the increased transmission and the increased time each ion spends inside the stability region.

When U and V are strictly linear functions as of time, the time that an ion spends inside the stability region is directly proportional to its mass-to-charge ratio (m/z). This results in mass spectral peaks whose widths are also directly proportional to m/z. Because the ratio of peak width to m/z is constant, we refer to this as constant resolving power mode. Because the operating line is invariant, the fine structure of each mass spectral peak is also invariant after a time dilation. The time dilation accounts for the varying speeds at which the ions traverse the same operating line. For example, a peak at m/z can be superimposed upon a peak at 2 m/z after dilating the mass axis by a factor of two. In conventional practice, however, the RF and DC voltages are applied to deliver constant peak widths, rather than constant resolving power. It is possible to choose an affine function of U, i.e. linear in time plus a constant offset and a function of V that varies strictly linearly in time that delivers the desired constant peak widths. The constant offset of U has the effect of making the slope of the operating line 2U/V vary continuously with time. As a result, although the peak width is constant, two peaks at different m/z are not superimposable. The fine structure of any peak will be unique as it has traversed a unique path through the stability region.

In the methods described in U.S. Ser. No. 12/716,138, i.e., QStream™, a sequence of ion images are acquired, in which each signal from distinct ion component can be related to a common reference signal. This property is achieved by the constant resolving power mode of operation, in which the ratio of U/V is held constant. Suppose that an ion of mass-to-charge ratio m is placed at position (q,a) within the stability region at time t by the constant resolving power mode of operation. Then, an ion of mass-to-charge ratio km will be placed at the identical position (q,a) at time kt. Not only is ion m stable at time t and ion km stable at time kt, but in fact, the position that they exit the quadrupole rods spatially are also the same, assuming that they enter the quadrupole rods with the same initial conditions, i.e., axial speed, transaxial velocity, transaxial displacement, and with the same RF phase. Because this property is satisfied by statistical ensembles of ions, the images captured by, for example, an arrayed detector, as formed by ions of various masses are related by simple time dilations. That is, the set of images produced by ions of mass-to-charge ratio m is the same as the set of images produced by ions of mass-to-charge ratio km after the time axis of the first is stretched by a factor of k.

Thus, the important principle generally described in U.S. Ser. No. 12/716,138 is that it is beneficial to first measure a set of images produced by any one homogeneous population of ions to form a "reference signal". Then, in a mixture of arbitrary ions, the observed signals can be written as the superposition of individual components, which are scaled versions of the measured reference signal. The scaling is vertical, to address abundance differences and horizontal, to address difference in mass-to-charge ratios.

It was immediately recognized that if the various component signals are related to the arbitrary reference signal by time shifts, rather than time dilations, that the acquired data could be interpreted as the convolution of the reference signal with the underlying distribution of mass-to-charge ratios (i.e. mass spectrum). Therefore, the underlying mass spectrum could be reconstructed by deconvolution. Deconvolution is simple, fast, and elegant, and thus desirable. However, initial experiments, first in simulation and subsequently, on a prototype instrument, did not provide a mode of operation that enabled the desired time shift property over certain mass ranges. To compensate for this and yet provide useful results via the methodology described above, the RF and DC necessitated linear scanning but only over small mass ranges and relatively narrow stability limits. As an example, one might scan from masses 500-520. In such a mode of operation, k ranges from 0.98 to 1.02 relative to a reference signal at mass 510. Using such narrow scan ranges, the dilation of the mass axis can be essentially ignored and the relationships between the observed component signals (from different ions in a mixture) can be approximated as (pure) time shifts.

While such a "linear scanning" mode of operation provides increased mass resolving power and simultaneous increased sensitivity, it is limited in operation because it reduces the accuracy of the deconvolution result and forces the data to be "stitched" together out of small chunks to form a complete mass spectrum. Moreover, in such a "stitched" together mode of operation, multiple reference signals often need to be measured at intervals across the mass range so that each chunk contains only small dilations of the time/mass axis. Fortunately, there is a novel alternative solution, which is the subject of the current patent application, as disclosed hereinafter.

Specific Description

The present invention, by contradistinction, provides a desired beneficial property of generating component signals that are related by time shifts, without time dilation over any mass range, via the utilization of a scan function of a quadrupole instrument that is exponential in time rather than linear. In this novel approach, U(m/z) and V(m/z) in contrast to the illustrative example above for a common mode of operation, is generally set to, for example, $U=c1\ \exp(s*t)$, and $V=c2\ \exp(s*t)$, with s being a constant that describes the ratio of the speed at which any ion passes through a given value of q and a.

To illustrate this novel arrangement of exponential scanning of a quadrupole instrument, suppose, as before, that an ion of mass-to-charge ratio m is placed at Mathieu coordinates (q*,a*) at time t. An ion of mass-to-charge ratio of km is thus placed at (q*,a*) at time $t+\Delta t$, where $\exp(s\Delta t)=k$, or equivalently $\Delta t=\log(k)/s$. a key aspect to be noted from the foregoing equations is that the time shift is independent of the Mathieu coordinates q and a. Thus, the signal from an ion of arbitrary mass is carried by a time shift onto the reference signal. Such a time shift simply depends upon the ratio of the ion's m/z values and the scan rate. To form a mass spectrum from a collection of images, mathematical deconvolution is thereafter performed in the time domain and then the values on the time axis are transformed to m/z values by exponentiation.

An important aspect of this mode of operation to be appreciated is that the deconvolution process yields super-resolution. i.e., the ability to discriminate ion masses that are less than the width of the mass stability limits and without the cumbersome task of "stitching" together chunks of data to form the acquired mass spectrum as necessitated in U.S. Ser. No. 12/716,138. For example, the mass resolving power on a typical quadrupole is defined as $m/\Delta m$, where $\Delta m$ is the width of the mass stability limits. In theory, high resolving power in a quadrupole can be acquired by narrowing the mass stability limits, as somewhat described above. However, what is not described above is that in practice, narrowing the mass stability limits causes a precipitous drop in ion intensity due to non-ideality in the quadrupole field, the finite size of the orifice formed by the rods, and dispersion in the ion's initial conditions entering the quadrupole. Thus, a quadrupole mass spectrometer is typically operating at unit resolution, or a mass resolving power ranging from several hundred to one or two thousand.

However, by virtue of exponential scanning of the RF and DC applied voltages as an improvement to that described in U.S. Ser. No. 12/716,138, ions can be distinguished whose difference in mass is much smaller than the mass stability limits by virtue of their differing positions in the quadrupole's exit plane as a function of time. The stability limits can be set quite wide, e.g., 10 Da or greater, so that the ion intensity is substantially higher, than even at unit resolution. In a scanning mode, the wide stability limits also lead to proportionately longer "dwell times", the interval of time in which the ion is stable and thus detected.

As a result, mass resolving power in the tens of thousands as an aforementioned improvement to that described in U.S. Ser. No. 12/716,138 and deemed QStream™, can be achieved far in excess of what is typical for a quadrupole mass spectrometer when it is operated in the conventional mode with a single detector. Specifically, by using wide mass stability limits of about 1 up to about 300 Daltons or greater, high mass resolving power is achieved without sacrificing sensitivity.

Interestingly and somewhat surprisingly, the resultantly beneficial properties of exponential scanning of RF and DC applied voltages to the sets of electrodes in a quadrupole are not limited to QStream™, where ion images are acquired often using arrayed detection schemes, but extend also, when coupled to the other aspects disclosed herein, to exponential scanning of conventional quadrupole mass filters and even quadrupole ion traps. For example, a conventional quadrupole mass filter can be thought of as the case of an array of N detectors where N=1. A reference signal can be obtained which is simply a single intensity versus time. Mathematical deconvolution can be performed using the same equations as described herein.

It is to be appreciated by those skilled in the art that deconvolution-based approaches cannot be used to extract super-resolution information from data that is collected on quadrupole mass filter operated in the conventional mode of operation. As discussed previously, in the conventional mode, the RF and DC are scanned linearly in time. The limitations of linear scanning are addressed above. In addition, the RF and DC are not maintained in constant proportion.

To further understand the problem, conventional quadrupole mass spectrometers are operated to deliver mass spectra whose peaks have the same width (e.g. 0.7 Da) across the entire mass spectrum. If the mass spectrometer is operated with a constant RF/DC ratio, the peak width varies linearly with mass. For example, if an ion of mass-to-charge ratio m is stable at times ranging from $t^*-\Delta t$ to $t^*+\Delta t$, then an ion of mass-to-charge ratio km is stable at times ranging from $k(t^*-\Delta t)$ to $k(t^*+\Delta t)$, and thus the second peak is k times wider than the first. It is important to note that the resolving power in this case is constant, i.e., Resolving Power $(m/\Delta m)=(km)/(k\Delta m)$.

To deliver constant peak widths rather than constant resolving power, a small DC offset is applied conventionally during the scan with the effect of monotonically increasing the RF/DC ratio. This type of arrangement keeps the mass stability limits constant, counteracting the dilation of the peak that can otherwise occur.

The overall result is that a conventional mode of operation precludes the use of a deconvolution-based method to generate super-resolution mass spectra. The DC offset applied in conventional quadrupole mass spectrometry causes different ions to traverse different paths through the stability diagram. As disclosed in U.S. Ser. No. 12/716,138, although different ions have peaks of similar widths, the motions of the ions are completely different and cannot be superimposed by a shift, dilation, or any other transformation of the time axis if one is using conventional techniques. Even with a single detector, the peaks might appear qualitatively similar (i.e., somewhat square-shaped with same peak width), wherein the fine structure in the intensity profile can no longer superimpose.

In contrast, by scanning the RF and DC on a quadrupole mass filter exponentially versus time and with a constant RF/DC ratio as indicated by the equations described above, $U=c1\ \exp(s^*t)$ and $V=c2\ \exp(s^*t)$, data can be acquired in which the component signal ("peak") from each ion is related to a reference signal by a simple time shift. This beneficial property allows super-resolution mass spectra to be generated by mathematical deconvolution. Such spectra, using the novel approach disclosed herein, are distinguished from conventional quadrupole mass spectrometry by a resultant high mass resolving power at high sensitivity.

As a method of operation in addition to, but not limited to exponential scanning, the present application often also requires: 1) calibrating a constructed instrument that controls applied voltages (i.e., the RES_DAC) so that the scan line passes through the origin, 2) collecting a reference peak for deconvolution, 3) applying the deconvolution to the raw data, and then 4) transforming to a (linear) mass axis.

The relation $dq/dt=s^*q$, provided by exponential scanning can also be implemented in the operation of an ion trap, as briefly stated above. In an ion trap, the q of interest is determined by the resonance ejection waveform. In an ion trap operated in the conventional linear scanning mode, the secular frequency of a light ion approaches the resonant ejection frequency at a different rate than for a heavy ion. In an exponential scanning mode, as disclosed herein, all ions approach the resonant ejection frequency at the same rate. This desirable property eliminates one major source of mass-dependent variation in the peak shape. Further refinements to the operation of the ion trap may be necessary to eliminate other sources of mass-dependent peak shape variation.

Accordingly, super-resolution, i.e., resolution of two masses whose mass spacing is significantly less than the FWHM of a peak, can be accomplished in the present application based upon deconvolution using an accurately specified peak shape model, which is mass-invariant. In addition to being applied to techniques described in U.S. Ser. No. 12/716,138 (e.g., via Qstream™), the present methodologies also enable conventional quadrupole mass filters and quadrupole ion traps to also benefit from an exponential scanning mode, which endeavors to generate mass-invariant peak shapes in the (exponential) time domain, where deconvolution and transformation can produce super-resolved mass spectra.

The exponential scanning itself can be implemented without changing the firmware. At that level, device settings are defined in terms of mass. So, it is simple to modify the relation between mass and time in the Digital Signal Processor (DSP) from linear to exponential. As a beneficial arrangement, a bit in the event flag can be introduced indicating that a given segment is scanned exponentially rather than linear.

The RF (V) and DC (U) values are thus capable of being ramped exponentially in time so that the corresponding q and a values for desired ions also increase at the exponential rate. A user of a conventional quadrupole system in wanting to provide selective scanning (e.g., unit mass resolving power) of a particular desired mass often configures his or her system with chosen a:q parameters and then scans at a predetermined discrete rate, e.g., a scan rate at about 500 (AMU/sec) to detect the signals.

However, while such a scan rate and even slower scan rates can also be utilized herein to increase desired signal to noise ratios, the present invention can also optionally increase the scan velocity up to about 10,000 AMU/sec and even up to about 100,000 AMU/sec as an upper limit because of the wider stability transmission windows and thus the broader range of ions that enable an increased quantitative sensitivity. Benefits of increased scan velocities include decreased measurement time frames, as well as operating the present invention in cooperation with survey scans, wherein the a:q points can be selected to extract additional information from only those regions (i.e., a target scan) where the signal exists so as to also increase the overall speed of operation.

Figure 2:
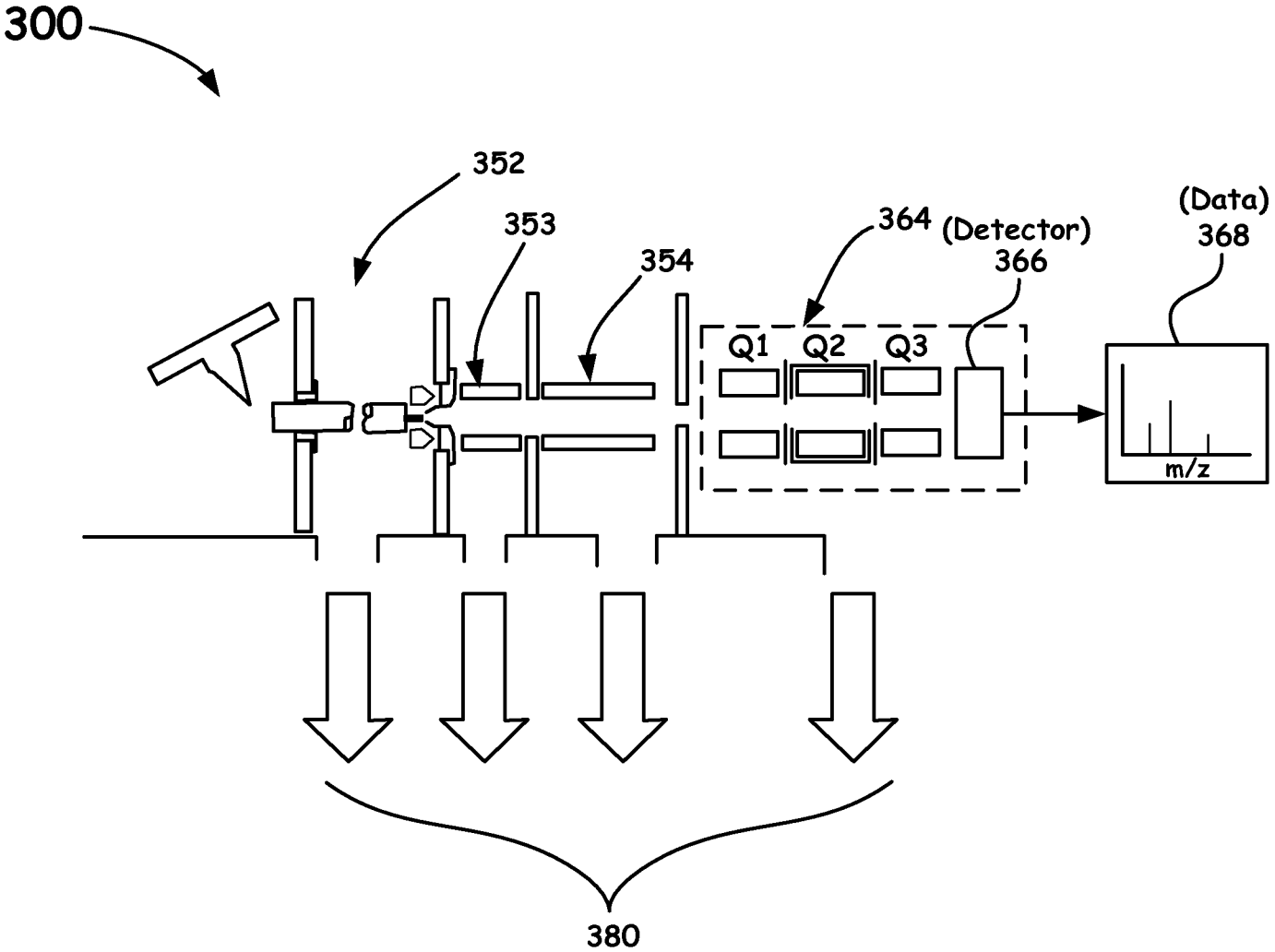
FIG. 2 shows a beneficial example configuration of a triple stage mass spectrometer system that can be operated with the methods of the present invention.

Turning back to the drawings, FIG. 2 shows a beneficial example configuration of a triple stage mass spectrometer system (e.g., a commercial Thermo Fisher Scientific TSQ), as shown generally designated by the reference numeral 300 having a detector 366, e.g., a single conventional detector (a Faraday Detector), and/or a time and spatial detector, e.g., an arrayed detector (CID, arrayed photodetector, etc.). Such a detector 366 is beneficially placed at the channel exit of the quadrupole (e.g., Q3 of FIG. 2) to provide data that can be by mathematical deconvolution, reconstructed into a rich mass spectrum 368. The resulting time-dependent data resulting from such an operation is converted into a mass spectrum by applying deconvolution methods described herein that convert the collection of recorded ion arrival times of a quadrupole or arrival times in addition to spatial positions at an exit plane of the quadrupole, into a set of m/z values and relative abundances.

The detector itself can be a conventional device (e.g., a Faraday cage) to record the allowed ion information. By way of such an arrangement, the time-dependent ion current collected provides for a sample of the envelope at a given position in the beam cross section as a function of the ramped exponential voltages. Importantly, because the envelope for a given m/z value and ramp voltage is approximately the same as an envelope for a slightly different m/z value and a shifted ramp voltage, the time-dependent ion currents collected for two ions with slightly different m/z values are also related by a time shift, corresponding to the shift in the applied exponentially ramped RF and DC voltages. The appearance of ions in the exit cross section of the quadrupole depends upon time because the RF and DC fields depend upon time. In particular, because the RF and DC fields are controlled by the user, and therefore known, the time-series of ions collected can be beneficially modeled using the solution of the well-known Mathieu equation for an ion of arbitrary m/z.

However, while the utilization of a conventional time-dependent detector can be utilized, it is to be appreciated that a time dependent/spatial (e.g., an arrayed detector) can also be utilized as there are in effect multiple positions at a predetermined spatial plane at the exit aperture of a quadrupole as correlated with time, each with different detail and signal intensity. In such an arrangement, the applied DC voltage and RF amplitude can be stepped synchronously with the RF phase to provide measurements of the ion images for arbitrary field conditions. By changing the applied fields with either detector arrangement, the present invention can obtain information about the entire mass range of the sample.

As a side note, there are field components that can disturb the initial ion density as a function of position in the cross section at a configured quadrupole opening as well as the ions' initial velocity if left unchecked. For example, the field termination at an instrument's entrance, e.g., Q3's, often includes an axial field component that depends upon ion injection. As ions enter, the RF phase at which they enter effects the initial displacement of the entrance phase space, or of the ion's initial conditions. Because the kinetic energy and mass of the ion determines its velocity and therefore the time the ion resides in the quadrupole, this resultant time determines the shift between the ion's initial and exit RF phase. Thus, a small change in the energy alters this relationship and therefore the exit image as a function of overall RF phase. Moreover, there is an axial component to the exit field that also can perturb the image. While somewhat deleterious if left unchecked, the present invention can be configured to mitigate such components by, for example, cooling the ions in a multipole, e.g., a configured collision cell for Q2, as shown in FIG. 2, and injecting them on axis or preferably slightly off-center by phase modulating the ions within the device. The direct measurement a reference signal rather than direct solution of the Mathieu equation, allows one to account for a variety of non-idealities in the field. The Mathieu equation can in such a situation be used to convert a reference signal for a known m/z value into a family of reference signals for a range of m/z values. This technique provides the method with tolerance to non-idealities in the applied field.

In returning to the mass spectrometer system of FIG. 2, it is to be appreciated, as discussed above, that the exponential ramping method of the present embodiments may also be practiced in connection with other mass spectrometer systems and/or other systems having architectures and configurations different from those depicted herein. To reiterate, the quadrupole mass spectrometer system 300 shown in FIG. 2 differs from a conventional quadrupole mass-spectrometer in that the present invention not only provides exponential ramping of the applied RF and DC fields but also without a DC voltage offset.

In further discussing FIG. 2, ions provided by source 352 are, as known to those skilled in the art, capable of being directed via predetermined ion optics that often can include tube lenses, skimmers, and multipoles, e.g., reference characters 353 and 354, selected from radio-frequency RF quadrupole and octopole ion guides, etc., so as to be urged through a series of chambers of progressively reduced pressure that operationally guide and focus such ions to provide good transmission efficiencies. The various chambers communicate with corresponding ports 380 (represented as arrows in the figure) that are coupled to a set of pumps (not shown) to maintain the pressures at the desired values.

The example system 300 of FIG. 2 is also shown illustrated as a triple stage configuration 364 having sections labeled Q1, Q2 and Q3 electrically coupled to respective power supplies and control instruments (not shown) so as to perform as a quadrupole ion guide, as also known to those of ordinary skill in the art. It is to be noted that such pole structures of the present invention can be operated either in the radio frequency (RF)-only mode or an RF/DC mode but often, as preferred herein, in an exponential RF ramped mode without an applied linear DC offset. Depending upon the particular applied RF and DC potentials, only ions of selected charge to mass ratios are allowed to pass through such structures with the remaining ions following unstable trajectories leading to escape from the applied quadrupole field. As the ratio of DC to RF voltage, but in proportion, increases, the transmission band of ion masses narrows so as to provide for mass filter operation, as known and as understood by those skilled in the art.

In the preferred embodiments, desired ramped RF and DC voltages are applied to predetermined opposing electrodes of the quadrupole devices of the present invention, as shown in FIG. 2 (e.g., Q3), in a manner to provide for a predetermined stability transmission window (e.g., from about 1 Dalton up to about 300 Daltons wide or greater) designed to enable a larger transmission of ions to be directed through the instrument, collected at the exit channel of the quadrupole (e.g., Q3) by the detector 366, and processed so as to determine mass characteristics. As understood as a key aspect of the novelty herein, the exponentially applied RF voltage and the corresponding exponentially applied DC voltage are in constant proportions to account for the time shifts of ions of distinct species traversing the stability region (see FIG. 1). While the exponentially applied RF and DC voltages of the present application are preferably maintained in constant proportion during the progression of ramping, it is equally to be understood that the present embodiments can also operate with the applied exponentially ramped RF and DC voltages being applied in a manner that are not in constant proportion during the progression of ramping. However, such an application entails further difficulties in deconvolution of the acquired data.

The operation of mass spectrometer 300 can be controlled and data can be acquired by a controller and data system (not depicted) of various circuitry of a known type, which may be implemented as any one or a combination of general or special-purpose processors (digital signal processor (DSP)), firmware, software to provide instrument control and data analysis for a single channel or arrayed detector 366 shown in FIG. 2 but also for other mass spectrometers and/or related instruments, and/or hardware circuitry configured to execute a set of instructions that enable the control of such instrumentation. Such processing of the data received from the detector 366 and associated instruments may also include averaging, scan grouping, deconvolution, library searches, data storage, and data reporting.

It is also to be appreciated that instructions to start predetermined slower or faster scans as disclosed herein, the identifying of a set of m/z values within the raw file from a corresponding scan, the merging of data, the exporting/displaying/outputting to a user of results, etc., may be executed via a data processing based system (e.g., a controller, a computer, a personal computer, etc.), which includes hardware and software logic for performing the aforementioned instructions and control functions of the mass spectrometer 300.

In addition, such instruction and control functions, as described above, can also be implemented by a mass spectrometer system 300, as shown in FIG. 2, as provided by a machine-readable medium (e.g., a computer-readable medium). A computer-readable medium, in accordance with aspects of the present invention, refers to mediums known and understood by those of ordinary skill in the art, which have encoded information provided in a form that can be read (i.e., scanned/sensed) by a machine/computer and interpreted by the machine's/computer's hardware and/or software.

Thus, as mass spectral data of a given spectrum is received by a beneficial detector 366 as directed by the quadrupole 364 configured in system 300, as shown in FIG. 2, the information embedded in a computer program of the present invention can be utilized, for example, to extract data from the mass spectral data, which corresponds to a selected set of mass-to-charge ratios. In addition, the information embedded in a computer program of the present invention can be utilized to carry out methods for normalizing, shifting data, or extracting unwanted data from a raw file in a manner that is understood and desired by those of ordinary skill in the art.

Turning back to the example mass spectrometer 300 system of FIG. 2, a sample containing one or more analytes of interest can be ionized via an ion source 352 operating at or near atmospheric pressure or at a pressure as defined by the system requirements. The ion source 352 in particular can include, an Electron Ionization (EI) source, a Chemical Ionization (CI) source, a Matrix-Assisted Laser Desorption Ionization (MALDI) source, an Electrospray Ionization (ESI) source, an Atmospheric Pressure Chemical Ionization (APCI) source, a Nanoelectrospray Ionization (NanoESI) source, and an Atmospheric Pressure Ionization (API), etc.

Depending upon the particular exponentially applied RF and DC potentials (and at a constant RF/DC ratio) to the quadrupole (e.g., Q3), only ions of selected mass to charge (m/z) ratios are allowed to pass with the remaining ions following unstable trajectories leading to escape from the applied multipole field. Accordingly, the exponentially applied RF and DC voltages to predetermined opposing electrodes of the multipole devices of the present invention, as shown in FIG. 2 (e.g., Q3), can be applied in a manner to provide for a predetermined stability transmission window designed to enable a larger transmission of ions to be directed through the instrument, collected at the exit aperture and processed so as to determined mass characteristics.

An example quadrupole, e.g., Q3 of FIG. 2, can thus be configured along with the collaborative components of a system 300 to provide a mass resolving power of potentially up to about 1 million with a quantitative increase of sensitivity of up to about 200 times as opposed to when utilizing typical quadrupole scanning techniques. In particular, the exponentially applied RF and DC voltages can be scanned over time to interrogate stability transmission windows over predetermined m/z values (e.g., 300 AMU). Thereafter, the ions having a stable trajectory reach a detector 366 capable of time resolution on the order of 10 RF cycles.

Analysis of "Linear Scanning" (RF Linear Versus Time, DC Affine Versus Time)

Consider the most general case of linear scanning given by Equations 1 and 2:

$$U(t)=c_1t+U_o, \tag{1}$$

$$V(t)=c_2t. \tag{2}$$

As shown by Equations 1 and 2 above, the RF amplitude V(t) is linear in time, but the present embodiments allow a constant offset in U(t), making U(t) affine rather than strictly linear. The offset $U_0$ is required for constant peak-width operation as shown below.

Consider a particular ion with mass m and charge z=1. We choose z=−1 without loss of generality to simplify our equations below. Then, the Mathieu parameters for this ion as a function of time are $$q(t) = \frac{4V(t)}{\omega^2 r_0^2 m} = \frac{kV(t)}{m} = \frac{kc_2t}{m} \tag{3}$$

$$a(t) = \frac{8U(t)}{\omega^2 r_0^2 m} = \frac{2kU(t)}{m} = \frac{2k(c_1t+U_o)}{m} \tag{4}$$

where k is a constant given by:

$$k = \frac{4}{\omega^2 r_0^2}. \tag{5}$$

For c1>0 and c2>0, the ion's position in the stability diagram (see FIG. 1 as a reference) at time 0 is (0.2 $kU_0$/m) and moves diagonally upward and to the right in a straight line with slope c1/c2 at a constant rate.

The goal is to determine the interval of time during which the chosen ion is stable. This leads to a set of mass calibration equations that allows one to interpret the time interval in terms of a peak width in units of mass. In particular, it is desirable to understand the effect of different values of $c_1$, $c_2$, and $U_0$.

First, to simplify the analysis, one considers the stability region only in the neighborhood of its apex, which is denoted by (q*,a*). In a small neighborhood, the boundaries of the stability region can be approximated as the intersection of two straight lines $a_L$ and $a_R$ that intersect at (q*,a*), as shown by equations 6 and 7 below:

$$a_L=a^*+s_L(q-q^*) \tag{6}$$

$$a_R=a^*+s_R(q-q^*) \tag{7}$$

where $s_L$ and $s_R$ denote the slopes of the left and right boundary lines respectively. The approximate values for $s_L$ and $s_R$ are 0.61 and −1.17 respectively.

The ion enters the stability diagram when the ion's trajectory intersects the left boundary line and exits when it intersects the right boundary line. The entrance time, for example, is determined by plugging the expression for a(t) from right-hand side of Equation 4 for aL in the left-hand side of Equation 6 and plugging the expression for q(t) from right-hand side of Equation 3 for q in the right-hand side of Equation 7. One replaces t by $t_L$ in Equation 8 below to denote that the value of t that solves this equation represents the time when the ion crosses the left boundary:

$$\frac{2k(c_1t_L+U_o)}{m} = a^* + s_L(c_2t_L - q^*). \tag{8}$$

Solving for $t_L$, results in:

$$t_L = \frac{a^* - s_Lq^*}{k(2c_1 - s_Lc_2)}m - \frac{2U_o}{k(2c_1 - s_Lc_2)}. \tag{9}$$

The entrance time depends linearly upon mass with a scaling factor relating time and mass that depends upon the scan rates $c_1$ and $c_2$, the constant k that depends upon the RF field, and geometric constants that describe the stability region. A similar equation (not shown) gives the exit time and is obtained by replacing $s_L$ with $s_R$.

Suppose the ion of mass m and charge 1 is analyzed by the quadrupole mass spectrometer with RF and DC scanned as defined by Equations 1 and 2. Then, in theory, ions of that type will reach the detector during the time interval ($t_L$, $t_R$) and a peak will be observed spanning that interval in the acquired data.

The time-centroid of the peak, denoted by tc, or more precisely, the midpoint between the entrance and exit times, is given by Equation 10:

$$t_c = \frac{1}{2}(t_L + t_R). \tag{10}$$

The peak width, denoted by Dt, or more precisely, the time difference between the entrance and exit times, is given by:

$$t_c = t_R - t_L. \tag{11}$$

The expressions for the time-centroid and peak width can be derived by plugging in the right-hand side of Equation 9 for $t_L$ and the analogous expression for $t_R$ where these variables appear in the right-hand side of Equations 10 and 11 respectively. The expressions are complicated and do not provide much insight. However, there are three special cases to consider that do provide insight.

Case 1: Infinite Resolution

The ratio a(t)/q(t) is the slope of the operating line. In this case, one chooses the slope so that the operating line passes through the apex of the stability diagram (q*,a*). Then set $U_0$=0, so that the operating line is the same for all ion masses, the line passing through the origin and (q*,a*). When $U_0$=0, the ratio a/q is constant and equal to 2c1/c2. One denotes the ratio 2c1/c2 by s in the following derivations:

$$s = \frac{2c_1}{c_2} = \frac{2U(t)}{V(t)} = \frac{a(t)}{q(t)} \tag{12}$$

Let s* denote the ratio of the apex coordinates a*/q*. To place the operating line at the apex of the stability region, we choose s equal to s*.

In this case, the expression for the entrance time, given in general, in Equation 9, simplifies considerably. The second term in the right-hand side of Equation 9 is zero because $U_0$=0. Setting 2c1=s*c2 produces the penultimate expression, which is further simplified by replacing s* with a*/q*, multiplying top and bottom by q* and cancelling the common factor of $a^* - s_L q^*$:

$$t_L = \frac{a^* - s_L q^*}{k(2c_1 - s_L c_2)} m = \frac{a^* - s_L q^*}{kc_2\,(s^* - s_L)} m = \frac{q^*}{kc_2} m. \tag{13}$$

By similar algebraic manipulations, $t_R = t_L$, and so, $t_C = t_L = t_R$. Replacing $t_L$ with $t_C$ in Equation 13 and solving for $t_C$ gives a mass calibration equation, as shown by Equation 14:

$$m = \frac{kc_2}{q^*} t_c. \tag{14}$$

When one operates with the scan line passing through the origin and the apex of the stability region, one has a linear relationship between time and mass. The scale factor depends upon k (quadrupole rod radius and frequency), c2 (scan rate), and q* (determined by the stability region).

Also, because $t_L = t_R$, the peak width Dt=0. In theory, one can have infinite resolution and also zero transmission. In fact, because the quadrupole is non-ideal, one has instead, finite resolution and non-zero transmission. Even so, the theoretical case of infinite resolution serves as a base case to compare the operating modes of constant peak-width and constant resolving power.

Case 2: Constant Peak Width

The typical mode of operation of a quadrupole mass filter is constant peak width mode. To produce constant peak width, one sets s=s* and $U_0$ to a non-zero constant. When $U_0$ is non-zero, the slope of the operating line changes as a function of time.

$$\frac{a(t)}{q(t)} = \frac{2U(t)}{V(t)} = \frac{2(c_1 t + U_o)}{c_2 t} = \frac{2c_1}{c_2} + \frac{2U_o}{c_2 t} \tag{15}$$

The slope would be infinite at t=0, but the operating line is undefined for t=0. As t increases, the slope gradually decreases and converges to a/q=s*, the apex of the stability region.

Now, consider an ion of mass m and charge 1, as before. The time at which t enters the stability region is given by Equation 16, formed by setting 2c1=s*c2 (i.e., s=s*) in Equation 9:

$$t_L = \frac{a^* - s_L q^*}{k(s^* - s_L)} m - \frac{2U_o}{kc_2(s^* - s_L)} = \frac{q^*}{kc_2} m - \frac{2U_o q^*}{kc_2(a^* - s_L q^*)} = t^* - \frac{2U_o q^*}{kc_2}\alpha_L, \tag{16}$$

where t* denotes the time that mass m crosses the stability region in the infinite resolution case:

$$t^* = \frac{q^*}{kc_2} m \tag{17}$$

and $\alpha_L$ is a constant that depends only on the geometry of the stability region:

$$\alpha_L = \frac{1}{a^* - s_L q^*}. \tag{18}$$

There is also an analogous expression for $t_R$. Then, $t_C$, the time centroid of the peak is given by:

$$t_C = t^* - \frac{U_o q^*}{kc_2}(\alpha_L + \alpha_R), \tag{19}$$

where $\alpha_R$ is a geometric constant analogous to $\alpha_L$.

If we apply the calibration relation given by Equation 14 to convert $t_C$ to mass, one has:

$$m_C = m - U_o(\alpha_L + \alpha_R) \tag{20}$$

We recognize that selecting a non-zero value for $U_0$ induces a mass shift, relative to the infinite resolution case where $U_0$=0. The mass shift is linear in $U_0$ and independent of m. The constant of proportionality for the mass shift depends only upon the geometric constants. The peak width is given by:

$$\Delta m = 2U_o(\alpha_R - \alpha_L). \tag{21}$$

To operate the system with a given constant peak width Dm, one chooses the required value for $U_0$ given in Equation 22:

$$U_o = \frac{\Delta m}{2(\alpha_R - \alpha_L)}. \tag{22}$$

Then, one calibrates out the mass shift introduced using Equation 20. Note that this constant peak-width mode, ironically, does not produce shift-invariant peaks. While it is true that the peaks have the same width, the ions traverse different (non-linear) paths through the stability diagram. As a result, the fine structure of the peak profiles does not align.

Case 3: Constant Resolving Power

To achieve constant resolving power, we set U0 back to zero, but choose s<s*, recalling that s is defined as 2c1/c2. In this case, the operating line does not change with time, but lies below the vertex of the stability diagram.

Let Ds denote the difference s*−s. Then, Equation 9 becomes:

$$t_L = \frac{a^* - s_L q^*}{kc_2(s - s_L)} m = \frac{a^* - s_L q^*}{kc_2(s^* - \Delta s - s_L)} m = \frac{q^*(a^* - s_L q^*)}{kc_2[(a^* - s_L q^*) - \Delta s]} m = \frac{q^* m}{kc_2}\left(\frac{1}{1 - \frac{\Delta s}{a^* - s_L q^*}}\right). \tag{23}$$

Because Ds<<a*−$s_L$q*, the right-hand side of Equation 23 can be approximated by a first-order Taylor series:

$$t_L \sim \frac{q^* m}{kc_2}\left(1 + \frac{\Delta s}{a^* - s_L q^*}\right) = \frac{q^* m}{kc_2}(1 + \Delta s \alpha_L). \tag{24}$$

The time-centroid of the peak is given by:

$$t_C \sim \frac{q^* m}{kc_2}\left[1 + \frac{\Delta s}{2}(\alpha_L + \alpha_R)\right]. \tag{25}$$

If we calibrate as before (Equation 14), we have:

$$m_C \sim m\left[1 + \frac{\Delta s}{2}(\alpha_L + \alpha_R)\right]. \tag{26}$$

In this case, we see that the mass shift is linear in mass. The resulting peak width is also linear in mass, as shown by Equation 27:

$$\Delta m \sim m \Delta s(\alpha_L - \alpha_R) \tag{27}$$

If we define the mass resolving power R as m/Dm, then one has:

$$R = \frac{m}{\Delta m} \sim \frac{1}{\Delta s(\alpha_L - \alpha_R)}. \tag{28}$$

We choose Ds to achieve the desired resolving power as shown in Equation 28.

$$\Delta S \sim \frac{1}{R(\alpha_L - \alpha_R)}. \tag{29}$$

This demonstrates that using a constant operating line ($U_0$=0) whose slope s is less than s* produces a mass spectrum with constant mass resolving power.

After we choose Ds, we derive the mass calibration relation by solving for m in Equation 25.

$$m \sim \frac{kc_2}{q^*\left[1 + \frac{\Delta s}{2}(\alpha_L + \alpha_R)\right]} t_C \tag{30}$$

In this constant resolving power case, the peaks have different widths, but ions traverse the same path through the stability diagram. As a result, the peaks are related by simple horizontal scaling or dilation. For example, a peak produced by an ion of mass m can be superimposed onto a peak for mass 2 m by scaling the former by a factor of two.

The advantage of operating in the constant resolution mode is that the peaks are superimposable. The present application requires, more strictly, that the peaks are superimposable by a time-shift, rather than a dilations. Fortunately, this can be accomplished by changing the time dependence of the RF and DC from linear to exponential, as disclosed herein.

Discussion of the Deconvolution Process

The deconvolution process is a numerical transformation of the data acquired from a specific mass spectrometric analyzer (e.g., a quadrupole) and a detector. All mass spectrometry methods deliver a list of masses and the intensities of those masses. What distinguish one method from another are how it is accomplished and the characteristics of the mass-intensity lists that are produced. Specifically, the analyzer that discriminates between masses is always limited in mass resolving power and that mass resolving power establishes the specificity and accuracy in both the masses and intensities that are reported. The term abundance sensitivity (i.e., quantitative sensitivity) is used herein to describe the ability of an analyzer to measure intensity in the proximity of an interfering species. Thus, the present invention utilizes a deconvolution process to essentially extract signal intensity in the proximity of such an interfering signal.

The instrument response to a mono-isotopic species can be described as a stacked series of two dimensional images, and that these images appear in sets that may be, but not necessarily if using a conventional detector, grouped into a three dimensional data packet described herein as voxels. Each data point is in fact a short series of images. Although there is the potential to use the pixel-to-pixel proximity of the data within the voxels, the data can be treated as two-dimensional, with one dimension being the mass axis and the other a vector constructed from a flattened series of images describing the instrument response at a particular mass. This instrument response has a finite extent and is zero elsewhere. This extent is known as the peak width and is represented in Atomic Mass Units (AMU). In a typical quadrupole mass spectrometer this is set to one and the instrument response itself is used as the definition of the mass spectrometer's mass resolving power and specificity. Within the instrument response, however, there is additional information and the real mass resolving power limit is much higher, albeit with additional constraints related to the amount of statistical variance inherent in the acquisition of weak ion signals.

Although the instrument response is not completely uniform across the entire mass range of the system, it is constant within any locality. Therefore, there are one or more model instrument response vectors that can describe the system's response across the entire mass range. Acquired data comprises convolved instrument responses. The mathematical process of the present invention thus deconvolves the acquired data (i.e., time series and/or time/spatial images) to produce an accurate list of observed mass positions and intensities.

Accordingly, the deconvolution process of the present invention is beneficially applied to data acquired from a mass analyzer that often comprises a quadrupole device, which, as known to those of ordinary skill in the art, has a low ion density. Because of the low ion density, the resultant ion-ion interactions are negligibly small in the device, effectively enabling each ion trajectory to be essentially independent. Moreover, because the ion current in an operating quadrupole is linear, the signal that results from a mixture of ions passing through the quadrupole is essentially equal to (N) overlapping sum of the signals produced by each ion passing through the quadrupole as received onto, for example, a single detector or arrayed detector.

The present invention capitalizes on the above-described overlapping effect via a model of detected data as the linear combination of the known signals that can be subdivided into sequential stages:

1) to produce a mass spectrum, intensity estimation under the constraint that the N signals are superimposed by unit time shifts; and 2) selection of a subset of the above signals with intensities significantly distinguishable from zero and subsequent refinement of their intensities to produce a mass list.

Accordingly, the following is a discussion of the deconvolution process of the one or more captured images resulting from a configured quadrupole, as performed by, for example, a coupled computer. To start, let a data vector $X=(X_1, X_2, \ldots X_J)$ denote a collection of J observed values. Let y, denote the vector of values of the independent variables corresponding to measurement $X_j$. For example, the independent variables in this application position in the exit cross section and time; so $y_j$ is a vector of three values that describe the conditions under which $X_j$ can be measured.

Theoretical Estimation of Optimal Intensities Scaling N Known Signals

In the general case for deconvoluting a linear superposition of N known signals: suppose one has N known signals $U_1, U_2, \ldots U_N$, where each signal is a vector of J components. There is a one-to-one correspondence between the J components of the data vector and the J components of each signal vector. For example, consider the nth signal vector $U_n=(U_{n1}, U_{n2}, \ldots U_{nJ})$: $U_{nj}$ represents the value of the nth signal if it were "measured" at $y_j$.

One can form a model vector S by choosing a set of intensities $I_1, I_2, \ldots I_N$, scaling each signal vector $U_1, U_2, \ldots U_N$, and adding them together as indicated by Equation 31.

$$S(I_1, I_2, \ldots I_N) = \sum_{n=1}^{N} I_n U_n \tag{31}$$

The model vector S has J components, just like each signal vector $U_1, U_2, \ldots U_N$, that are in one-to-one correspondence with the components of data vector X.

Let e denote the "error" in the approximation of X by S and then find a collection of values $I_1, I_2, \ldots I_N$ that minimizes e. The choice of e is somewhat arbitrary. As disclosed herein, one defines e as the sum of the squared differences between the components of data vector X and the components of model vector S, as shown in Equation 32.

$$e(I_1, I_2, \ldots I_N) = \sum_{j=1}^{J} (S_j(I_i, I_2, \ldots I_N) - X_j)^2 \tag{32}$$

The notation explicitly shows the dependence of the model and the error in the model upon the N chosen intensity values.

One simplifies Equation 32 by defining an intensity vector I (Equation 33), defining a difference vector Δ (Equation 34), and using an inner product operator (Equation 35).

$$I = (I_1, I_2, \ldots I_N) \tag{33}$$

$$\Delta(I_1, I_2, \ldots I_N) = S(I_1, I_2, \ldots I_N) - X \tag{34}$$

$$a \cdot b = \sum_{j=1}^{J} a_j b_j \tag{35}$$

In Equation 35, a and b are both assumed to be vectors of J components.

Using Equations 33-35, Equation 32 can be rewritten as shown in Equation 6.

$$e(I)=\Delta(I)\cdot\Delta(I) \tag{36}$$

Let I* denote the optimal value of I, i.e., the vector of intensities $I^*=(I_1^*, I_2^*, \ldots I_N^*)$ that minimizes e. Then, the first derivative of e with respect to I evaluated at I* is zero, as indicated by Equation 37.

$$\frac{\partial e}{\partial I}(I^*) = 0 \tag{37}$$

Equation 37 is shorthand for N equations, one for each intensity $I_1, I_2, \ldots I_N$.

One can use the chain-rule to evaluate the right-hand side of Equation 6: wherein the error e is a function of the difference vector A; A is a function of the model vector S; and S is a function of the intensity vector I, which contains the intensities $I_1, I_2, \ldots I_N$.

One then considers the derivative of e with respect to one of the intensities $I_m$, evaluated at (unknown) I*, where m is an arbitrary index in [1 . . . N].

$$\frac{\partial e}{\partial I_m}(I^*) = \frac{\partial}{\partial I_m}(\Delta(I)\cdot\Delta(I))\Big|_{I=I^*} = 2\frac{\partial \Delta}{\partial I_m}(I^*)\cdot\Delta(I^*) \tag{38}$$

$$\frac{\partial \Delta}{\partial I_m}(I^*) = \frac{\partial}{\partial I_m}(S(I) - X)\Big|_{I=I^*} = \frac{\partial S}{\partial I_m}(I^*) \tag{39}$$

$$\frac{\partial S}{\partial I_m}(I^*) = \frac{\partial}{\partial I_m}\left(\sum_{n=1}^{N} I_m U_n\right)\Big|_{I=I^*} = U_m \tag{40}$$

Now, one can use Equations 39-40 to replace $$\frac{\partial \Delta}{\partial I_m}(I^*)$$

in the right-hand side of Equation 38.

$$\frac{\partial e}{\partial I_m}(I^*) = 2U_m \cdot \Delta(I^*) \tag{41}$$

Then, one can use Equation 4 to replace $\Delta(I^*)$ in the right-hand side of Equation 11.

$$\frac{\partial e}{\partial I_m}(I^*) = 2U_m \cdot (S(I^*) - X) \tag{42}$$

Setting the right-hand side of Equation 42 to zero, as specified by the optimization criterion stated in Equation 37, results in Equation 43.

$$U_m \cdot S(I^*) = U_k \cdot X \tag{43}$$

Now, one can use Equation 1 to replace $S(I^*)$ in the left-hand side of Equation 43.

$$U_m \cdot \left(\sum_{n=1}^{N} I_n^* U_n\right) = U_m \cdot X \tag{44}$$

Note that Equation 14 relates the unknown intensities $\{I_n^*\}$ to the known data vector X and the known signals $\{U_n\}$. All that remains are algebraic rearrangements that leads to an expression for the values of $\{I_n^*\}$.

One uses the linearity of the inner product to rewrite the inner product of a sum that appears on the left-hand side of Equation 44 as a sum of inner products.

$$\sum_{n=1}^{N} I_n^*(U_m \cdot U_n) = U_m \cdot X \tag{45}$$

The left-hand side of Equation 45 can be written as the product of a row vector and a column vector as shown in Equation 46.

$$\sum_{n=1}^{N} I_n^*(U_m \cdot U_n) = [U_m \cdot U_1 U_m \cdot U_2 \ \ldots \ U_m \cdot U_n] \begin{bmatrix} I_1^* \\ I_2^* \\ \vdots \\ I_N^* \end{bmatrix} \tag{46}$$

One defines the row vector $A_m$ (Equation 47) and the scalar $a_m$ (Equation 48). Both quantities depend upon index m $$A_m = [U_m \cdot U_1 U_m \cdot U_2 \ldots U_m \cdot U_N] \tag{47}$$

$$a_m = U_m \cdot X \tag{48}$$

Using Equations 46-48, one can rewrite Equation 45 compactly.

$$A_m I^* = a_m \tag{49}$$

Equation 49 hold for each m in [1 . . . N]. We can write all N equations (in the form of Equation 45) in a column of N components.

$$\begin{bmatrix} A_1 \\ A_2 \\ \vdots \\ A_N \end{bmatrix} I^* = \begin{bmatrix} a_1 \\ a_2 \\ \vdots \\ a_N \end{bmatrix} \tag{50}$$

The column vector on the left-hand side of Equation 50 contains N row vectors, each of size N. This column of rows represents an N×N matrix that we will denote by A. One forms the matrix A by substituting 1 for m in Equation 47 and replacing $A_1$ in the first row of the column vector on the left-hand side of Equation 20. This process is repeated for indices 2 . . . N, thereby constructing an N×N matrix, whose entries are given by Equation 51.

$$A_{mn} = U_m \cdot U_n = \sum_{j=1}^{J} U_{mj} U_{nj} \tag{51}$$

As indicated by Equation 21, the matrix entry at row m, column n of matrix A is the inner product of the mth signal and the nth signal. One denotes the column vector on the right hand side of Equation 50 by a.

To summarize, the N equations are encapsulated as a single matrix equation:

$$AI = a \tag{52}$$

where the components of vector a that appears in the right-hand side of Equation 52 are defined by Equation 48.

In the trivial case, where none of the signals overlap, i.e., $A_{mn}=0$ whenever $m \neq n$, A is a diagonal matrix. In this case, the solution of the optimal intensities are given by $I_n^* = a_n / A_{nn}$, for each n in [1 . . . N]. Another special case is when the signals can be partitioned into K clusters such that $A_{mn}=0$ whenever m and n belong to distinct clusters. In that case, A is a block-diagonal matrix: the resulting matrix equation can be partitioned into K (sub) matrix equations, one for each cluster (or submatrix block). The block-diagonal case is still $O(N^3)$, but involves fewer computations than the general case.

In general, solving an equation of the form of Equation 22 has $O(N^3)$ complexity. That is, the number of calculations required to determine the N unknown intensities scales with the cube of the number of unknown intensities.

1) Special Case: The N Signals are Superimposable by Unit Time Shifts

In this section, some additional constraints are imposed on the problem so as to provide a dramatic reduction in the complexity of solving the general case of (Equation 52).

Constraint 1: any pair of signals $U_m$ and $U_n$ can be superimposed by a time-shift.

Constraint 2: the time shift between adjacent signals $U_n$ and $U_{n+1}$ is the same for all n in [1 . . . N−1].

An equivalent statement of constraint (1) is that all signals can be represented by a time-shift of a canonical signal U. This constraint is applicable to the high-mass resolving power quadrupole problem. The second constraint leads to an easily determined solution for detecting signals and providing initial estimates of their positions, despite significant overlap between the signals. These two constraints reduce the solution of Equation 52 from an $O(N^3)$ problem to an $O(N^2)$ problem, as disclosed herein below.

Constraint (1) above can be represented symbolically by Equation 53.

$$U_n[v,q] = U_m[v, q+n-m] \tag{53}$$

where v is a set of indices representing the values of all independent variables except time (i.e., in this case, position in the exit cross section and initial RF phase) and q is a time index. Because the signals are related by time shifts, it becomes necessary to distinguish between time and the other independent variables affecting the observations.

For Equation 53 to be well-defined, the collection of measurements taken at any time point m must involve the same collection of values of v as at any other time point n. Taking this property into account, the definition of the inner product (Equation 35) is rewritten in terms of time values and the other independent variables.

$$a \cdot b = \sum_{q=1}^{Q} \sum_{v=1}^{V} a[v, q] b[v, q] \tag{54}$$

where the total number of measurements J=QV, q is the time index, and v is the index for remaining values (i.e., the finite number of combinations of the values of the other independent variables are enumerated by a one dimensional index v).

In addition, because both $U_n$ and $U_m$ must be defined on the entire interval [1 . . . N], both signals must also be defined outside [1 . . . N]. A time shift of the interval [1 . . . N], or any other finite interval, would not be contained within the same interval. Therefore, all signals must be defined for all integer time points; presumably, outside some support region of finite extent, the signal value is defined to be zero.

The special property imposed by the constraints is revealed by considering the matrix entry $A_{(m+k)(n+k)}$. The short derivation below shows that one can write $A_{(m+k)(n+k)}$ in terms of $A_{mn}$, plus a term that, in many cases, are negligibly small.

$$\begin{aligned} A_{(m+k)(n+k)} &= U_{m+k} \cdot U_{n+k} \\ &= \sum_{q=1}^{Q} \sum_{v=1}^{V} U_{m+k}[v, q] U_{n+k}[v, q] \\ &= \sum_{q=1}^{Q} \sum_{v=1}^{V} U_m[v, q-k] U_n[v, q-k] \\ &= \sum_{q=1-k}^{Q-k} \sum_{v=1}^{V} U_m[v, q] U_n[v, q] \\ &= \sum_{q=1-k}^{0} \sum_{v=1}^{V} U_m[v, q] U_n[v, q] + \\ &\quad \sum_{q=1}^{Q} \sum_{v=1}^{V} U_m[v, q] U_n[v, q] - \\ &\quad \sum_{q=Q-k+1}^{Q} \sum_{v=1}^{V} U_m[v, q] U_n[v, q] \\ &= A_{mn} + \left( \sum_{q=1-k}^{0} \sum_{v=1}^{V} U_m[v, q] U_n[v, q] - \sum_{q=Q-k+1}^{Q} \sum_{v=1}^{V} U_m[v, q] U_n[v, q] \right) \end{aligned} \tag{55}$$

In Equation 55 above, the expression to the right of the first equals sign follows from the definition of the matrix entry (Equation 52); the next expression follows from the new inner product definition where time is distinguished from the other independent variables, (Equation 54); the next expression follows by applying the time-shift equation (Equation 53) to each factor in order to write them in terms of $U_m$ and $U_n$ respectively. The expression on the second line of Equation 55 involves replacing the summation index q by q+k. The expression on the third line of Equation 55 is the result of breaking the summation over the time index into three parts: the values of q less than 1, the values of q from 1 to Q, and then subtracting the extra terms from Q−k+1 to Q. The second of these three sums is $A_{mn}$ and this quantity is relabeled and pulled out front in the final expression.

To equate entry $A_{(m+k)(n+k)}$ with $A_{mn}$ for arbitrary values of k, one considers the term that appears in parentheses in the final expression in Equation 55 to be an error term. The error term comprises two terms referred to as "left" and "right". The "left" term is zero when either signal, $U_{m+k}$ or $U_{n+k}$, has decreased to zero before reaching the left edge of the time window where data had been collected; similarly, the "right" term is zero when either signal has decreased to zero before reaching the right edge of the data window.

Matrix A can be constructed by specifying the 2N−1 distinct values, placing the first N values in the first column of the matrix, in inverted order, i.e. from bottom to top, and then filling the remaining N−1 entries of the first row from left to right. The rest of the matrix is filled by filling each of the 2N−1 bands parallel to the main diagonal by copying the value from the left or upper edge of the matrix downward to the right until reaching the bottom or left edge respectively.

2) Estimation of the Number of Signals Present and their Positions

Finally, one considers how to use the initial estimates that result from solving the system. One does not expect that the data is, in fact, the realization of N evenly spaced signals. Rather, it is expected that the data is the realization of a relatively small number of signals (e.g. k<<N) that lie at arbitrary values of time. In this context, one expects that the majority of the N intensities results in zero. Estimated values that differ from zero may indicate the presence of a signal, but may also result from noise in the data, errors in the positions of the signals that are present, errors in the signal model, and truncation effects.

A threshold is applied to the intensity values, retaining only k signals, corresponding to distinct ion species that exceed a threshold and setting the remaining intensities to zero. The thresholded model approximates the data as the superposition of k signals. As a beneficial result for application purposes of the present invention, the solution of the system produces a set of intensity values that lead to the identification of the number of signals present (k) and the approximate positions of these k signals.

General Discussion of the Data Processing

The present invention is thus designed to express an observed signal as a linear combination of a time shifted reference signal or a plurality of constructed time-shifted signals. In the first case, the observed "signal" is the time series of acquired images of ions exiting the quadrupole. The time shifted reference signal or signals is the contribution or contributions to the observed signal from ions with different m/z values. The coefficients in the linear combination correspond to a mass spectrum.

Reference Signal and/or Signals:

To construct the mass spectrum for the present invention, it is beneficial to specify, for each m/z value, the signal, the time series of ion images that can be produced by a single species of ions with that m/z value. The approach herein is to measure a single reference signal by observing a test sample (e.g., Mass 508), offline as a calibration step.

At a given time, the observed exit ions depend upon three parameters—a and q and also the RF phase of the ions as they enter the quadrupole. The exit ions also depend upon the distribution of ion velocities and radial displacements, with this distribution being assumed to be invariant with time, except for intensity scaling.

While a family of reference signals can be constructed in terms of the measured reference signal but of which has some difficulties, a preferred method of the present application uses a single time-shifted reference signal based on integer multiples of the RF cycle. If a family of time-shifted reference signals (e.g., as constructed from the measured reference signal) are to be utilized, it is to compensate for non-idealities in the quadrupole field, as discussed above, or inability to deliver ions with mass-independent initial conditions to the entrance field of a configured quadrupole. In any event, a single time-shifted or plurality of family of time-shifted reference signals enables approximations of the expected signals for various ion species. It is also to be noted that the m/z spacing corresponding to an RF cycle is determined by the exponential scan rate of the present application.

To understand why the time-shift approximation works and to explore its limitations, consider the case of two pulses centered at $t_1$ and $t_2$ respectively and with widths of $d_1$ and $d_2$ respectively, where $t_2=kt_1$, $d_2=kt_2$, and $t1>>d_1$. Further, assume that k is approximately 1. The second pulse can be produced from the first pulse exactly by a dilation of the time axis by factor k. However, applying a time shift of $t_2$-$t_1$ to the first pulse would produce a pulse centered at $t_2$ with a width of $d_1$, which is approximately equal to $d_2$ when k is approximately one. For low to moderate stability limits (e.g. 10 Da or less), the ion signals are like the pulse signals above, narrow and centered many peak widths from time zero.

Because the ion images are modulated by a fixed RF cycle, the constructed and/or measured reference signal(s) cannot be related to the signal from arbitrary m/z value by a time shift; rather, it can only be related to signals by time shifts that are integer multiples of the RF period. That is, the RF phase aligns only at integer multiples of the RF period.

Matrix Equation:

The construction of a mass spectrum via the present invention is conceptually the same as in Fourier Transform Mass Spectrometry (FTMS). In FTMS as utilized herein, the sample values of the mass spectrum are the components of a vector that solves a linear matrix equation: Ax=b, as discussed in detail above. Matrix A is formed by the set of overlap sums between pairs of reference signals. Vector b is formed by the set of overlap sums between each reference signal and the observed signal. Vector x contains the set of (estimated) relative abundances.

Matrix Equation Solution:

In FTMS, matrix A is the identity matrix, leaving x=b, where b is the Fourier transform of the signal. The Fourier transform is simply the collection of overlap sums with sinusoids of varying frequencies.

Computational Complexity:

Let N be denote the number of time samples or RF cycles in the acquisition. In general, the solution of Ax=b has $O(N^3)$ complexity, the computation of A is $O(N^3)$ and the computation of b is $O(N^3)$. Therefore, the computation of x for the general deconvolution problem is $O(N^2)$. In FTMS, A is constant, the computation of b is O(N log N) using the Fast Fourier Transform. Because Ax=b has a trivial solution, the computation is O(N log N). In the present invention, the computation of A is $O(N^2)$ because only 2N−1 unique values need to be calculated, the computation of B is $O(N^2)$, and the solution of Ax=b is $O(N^2)$. Therefore, the computation of x—the mass spectrum—is $O(N^2)$.

The reduced complexity, from $O(N^2)$ to $O(N^2)$ is beneficial for constructing a mass spectrum in real-time. The computations are highly parallelizable and can be implemented on an imbedded GPU.

Further Performance Analysis Discussion

The key metrics for assessing the performance of a mass spectrometer are sensitivity, mass resolving power (MRP), and the scan rate. As previously stated, sensitivity refers to the lowest abundance at which an ion species can be detected in the proximity of an interfering species. MRP is defined as the ratio M/ΔM, where M is the m/z value analyzed and ΔM is usually defined as the full width of the peak in m/z units, measured at full-width half-maximum (i.e., FWHM). An alternative definition for ΔM is the smallest separation in m/z for which two ions can be identified as distinct. This alternative definition is most useful to the end user, but often difficult to determine.

In the present invention, the user can control the scan rate and the desired exponentially applied DC/RF amplitude ratio. By varying these two parameters, users can trade-off scan rate, sensitivity, and MRP, as described below. The performance of the present invention is also enhanced when the entrance beam is focused, providing greater discrimination.

Scan Rate:

Scan rate is typically expressed in terms of mass per unit time, but this is only approximately correct. As U and V are exponentially ramped, increasing m/z values are swept through the point (q*,a*) lying on the operating line, as shown above in FIG. 1. When U and V are ramped linearly in time, the value of m/z seen at the point (q*,a*) changes linearly in time, and so the constant rate of change can be referred to as the scan rate in units of Da/s. However, each point on the operating line has a different scan rate. When the mass stability limit is relatively narrow, m/z values sweep through all stable points in the operating line at roughly the same rate.

Sensitivity:

Fundamentally, the sensitivity of a quadrupole mass spectrometer is governed by the number of ions reaching the detector. When the quadrupole is scanned, the number of ions of a given species that reach the detector is determined by the product of the source brightness, the average transmission efficiency and the transmission duration of that ion species.

The sensitivity can be improved, as discussed above, by increasing the stability limits away from the tip of the stability diagram. The average transmission efficiency thus increases because the ion spends more of its time in the interior of the stability region, away from the edges where the transmission efficiency is poor. Because the mass stability limits are wider, it takes longer for each ion to sweep through the stability region, increasing the duration of time (i.e., the dwell time, as stated above) that the ion passes through to the detector for collection.

Duty Cycle:

When acquiring a full spectrum, at any instant, only a fraction of the ions created in the source are reaching the detector; the rest are hitting the rods. The fraction of transmitted ions, for a given m/z value, is called the duty cycle. Duty cycle is a measure of efficiency of the mass spectrometer in capturing the limited source brightness. When the duty cycle is improved, the same level of sensitivity can be achieved in a shorter time, i.e. higher scan rate, thereby improving sample throughput. In a conventional system as well as the present invention, the duty cycle is the ratio of the mass stability range to the total mass range present in the sample.

By way of a non-limiting example to illustrate an improved duty cycle by use of the methods herein, a user of the present invention can, instead of 1 Da (typical of a conventional system), choose stability limits (i.e., a stability transmission window) of 10 Da (as provided herein) so as to improve the duty cycle by a factor of 10. A source brightness of $10^9$/s is also configured for purposes of illustration with a mass distribution roughly uniform from 0 to 1000, so that a 10 Da window represents 1% of the ions. Therefore, the duty cycle improves from 0.1% to 1%. If the average ion transmission efficiency improves from 25% to nearly 100%, then the ion intensity averaged over a full scan increases 40-fold from $10^9/s*10^{-3}*0.25=2.5*10^5$ to $10^9/s*10^{-2}*1=10^7/s$.

Therefore, suppose a user of the present invention desires to record 10 ions of an analyte in full-scan mode, wherein the analyte has an abundance of 1 ppm in a sample and the analyte is enriched by a factor of 100 using, for example, chromatography (e.g., 30-second wide elution profiles in a 50-minute gradient). The intensity of analyte ions in a conventional system using the numbers above is $2.5*10^5*10^{-6}*10^2=250/s$. So the required acquisition time in this example is about 40 ms. In the present invention, the ion intensity is about 40 times greater when using an example 10 Da transmission window, so the required acquisition time in the system described herein is at a remarkable scan rate of about 1 ms.

Accordingly, it is to be appreciated that the beneficial sensitivity gain of the present invention as opposed to a conventional system comes from pushing the operating line downward (e.g., 300 AMU wide or greater) away from the tip of the stability region, as discussed throughout above, and thus widening the stability limits. In practice, the operating line can be configured to go down as far as possible to the extent that a user can still resolve a time shift of one RF cycle. In this case, there is no loss of mass resolving power; it achieves the quantum limit. Along those lines, the methods and instruments of the present invention not only provides high sensitivity, (i.e., an increased sensitivity 10 to 300 times greater than a conventional quadrupole filter) but also simultaneously provides for differentiation of mass deltas of 100 ppm (a mass resolving power of 10 thousand) down to about 10 ppm (a mass resolving power of 100 thousand) and for an unparalleled mass delta differentiation of 1 ppm (i.e., a mass resolving power of 1 million) if the devices disclosed herein are operated under ideal conditions that include minimal drift of all electronics.

As described above, the present invention can resolve time-shifts along the operating line to the nearest RF cycle. This RF cycle limit establishes the tradeoff between scan rate and MRP, but does not place an absolute limit on MRP and mass precision. The scan rate can be decreased so that a time shift of one RF cycle along the operating line corresponds to an arbitrarily small mass difference.

For example, suppose that the RF frequency is at about 1 MHz. Then, one RF period is 1 us. For a scan rate of 10 kDa/s, 10 mDa of m/z range sweeps through a point on the operating line. The ability to resolve a mass difference of 10 mDa corresponds to a MRP of 100 k at m/z 1000. For a mass range of 1000 Da, scanning at 10 kDa/s produces a mass spectrum in 100 ms, corresponding to a 10 Hz repeat rate, excluding interscan overhead. Similarly, the present invention can trade off a factor of x in scan rate for a factor of x in MRP. Accordingly, the present invention can be configured to operate at 100 k MRP at 10 Hz repeat rate, "slow" scans at 1M MRP at 1 Hz repeat rate, or "fast" scans at 10 k MRP at 100 Hz repeat rate. In practice, the range of achievable scan speeds may be limited by other considerations such as sensitivity or electronic stability.

Exemplary Modes of Operation

As one embodiment, the present invention can be operated in $MS^1$ "full scan" mode, in which an entire mass spectrum is acquired, e.g., a mass range of 1000 Da or more. In such a configuration, the scan rate can be reduced to enhance sensitivity and mass resolving power (MRP) or increased to improve throughput. Because the present invention provides for high MRP at relatively high scan rates, it is possible that scan rates are limited by the time required to collect enough ions, despite the improvement in duty cycle provided by present invention over conventional methods and instruments.

As another embodiment, the present invention can also be operated in a "selected ion mode" (SIM) in which one or more selected ions are targeted for analysis. Conventionally, a SIM mode, as stated previously, is performed by parking the quadrupole, i.e. holding U and V fixed. By contrast, the present invention scans U and V rapidly over a narrow mass range, and using wide enough stability limits so that transmission is about 100%. In selected ion mode, sensitivity requirements often dictate the length of the scan. In such a case, a very slow scan rate over a small m/z range can be chosen to maximize MRP. Alternatively, the ions can be scanned over a larger m/z range, i.e. from one stability boundary to the other, to provide a robust estimate of the position of the selected ion.

As also stated previously, hybrid modes of MS' operation can be implemented in which a survey scan for detection across the entire mass spectrum is followed by multiple target scans to hone in on features of interest. Target scans can be used to search for interfering species and/or improve quantification of selected species. Another possible use of the target scan is elemental composition determination. For example, the quadrupole of the present invention can target the "A1" region, approximately one Dalton above the monoisotopic ion species to characterize the isotopic distribution. For example, with an MRP of 160 k at m/z 1000, it is possible to resolve C-13 and N-15 peaks, separated by 6.3 mDa. The abundances of these ions provide an estimate of the number of carbons and nitrogens in the species. Similarly, the A2 isotopic species can be probed, focusing on the $C\text{-}13_2$, S-34 and O-18 species.

In a triple quadrupole configuration, the detector used in the present invention, as described above, can be placed at the exit of Q3. The other two quadrupoles, Q1 and Q2, are operated in a conventional manner, i.e., as a precursor mass filter and collision cell, respectively. To collect $MS^1$ spectra, Q1 and Q2 allow ions to pass through without mass filtering or collision. To collect and analyze product ions, Q can be configured to select a narrow range of precursor ions (i.e. 1 Da wide mass range), with Q2 configured to fragment the ions, and Q3 configured to analyze the product ions.

Q3 can also be used in full-scan mode to collect (full) MS/MS spectra at 100 Hz with 10 k MRP at m/z 1000, assuming that the source brightness is sufficient to achieve acceptable sensitivity for 1 ms acquisition. Alternatively, Q3 can be used in SIM mode to analyze one or more selected product ions, i.e., single reaction monitoring (SRM) or multiple reaction monitoring (MRM). Sensitivity can be improved by focusing the quadrupole on selected ions, rather than covering the whole mass range.

Non-Limiting Results

Figure 3A:
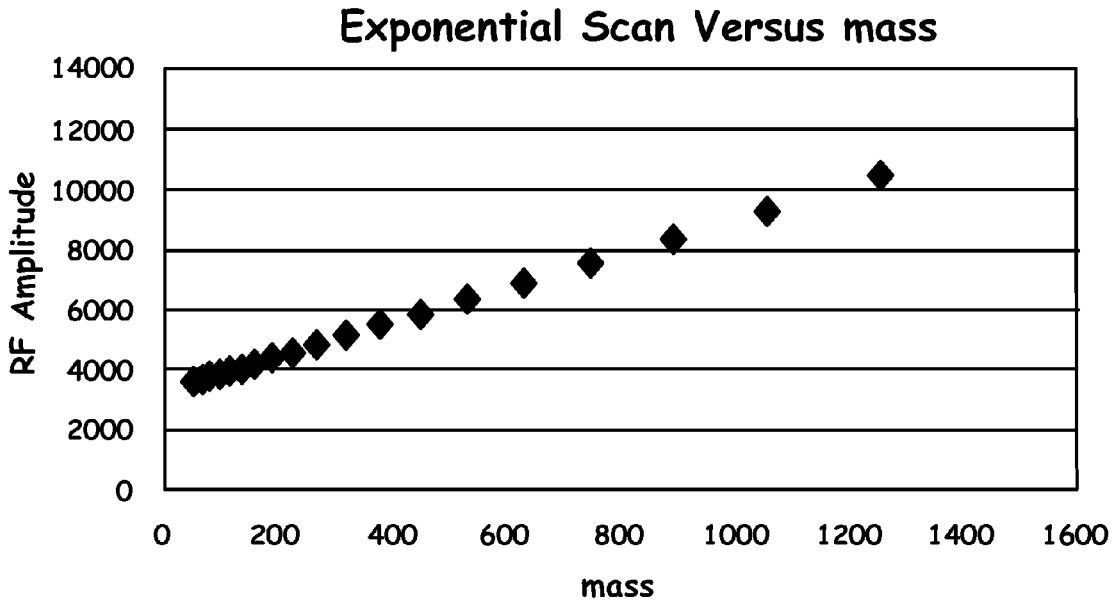
FIG. 3A shows exponential scanning of the applied RF voltage amplitude as a function of mass.
Figure 3B:
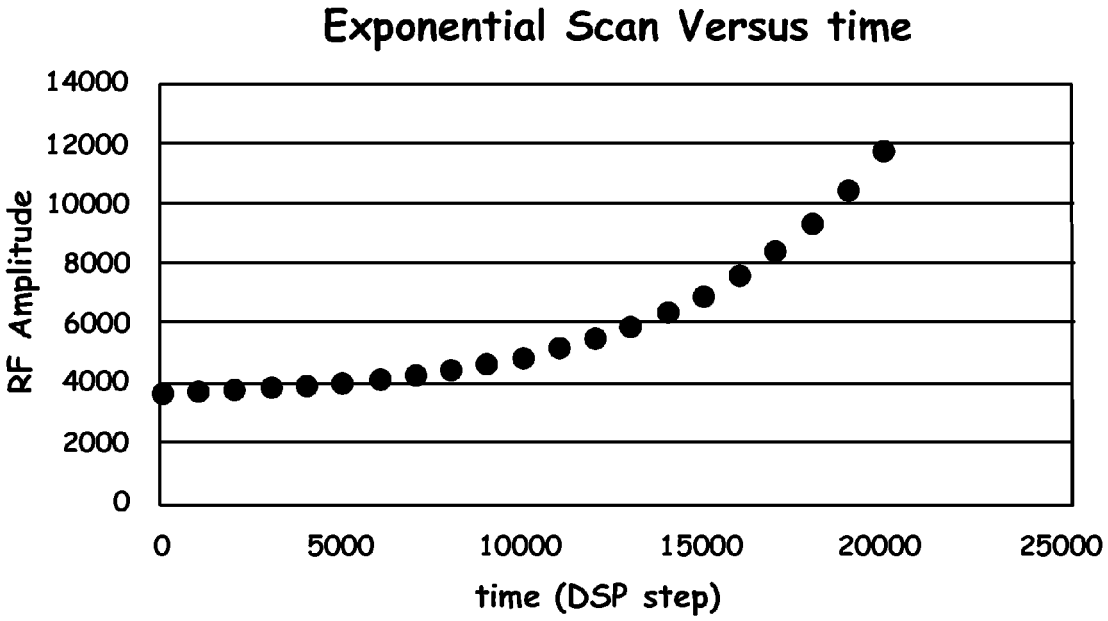
FIG. 3B shows exponential scanning of the applied RF voltage amplitude as a function of time.

FIG. 3A shows values of the data captured from a 1 sec scan from mass 50 to mass 1500 in an exponential scan of the RF amplitude plotted as a function of mass. FIG. 3A thus shows that the linear dependence between mass and the applied RF amplitude is still retained in an exponential scan. FIG. 3B beneficially shows the exponential time dependence of the RF amplitude, (the circle markers indicate an interval of 50 ms (1000 DSP ramp steps)), wherein the spacing between mass samples grow exponentially in time.

It is to be understood that features described with regard to the various embodiments herein may be mixed and matched in any combination without departing from the spirit and scope of the invention. Although different selected embodiments have been illustrated and described in detail, it is to be appreciated that they are exemplary, and that a variety of substitutions and alterations are possible without departing from the spirit and scope of the present invention.

The invention claimed is:

1. A mass spectrometer method, comprising:

measuring by way of a quadrupole, a reference signal representative of a measured or expected time distribution and/or time and spatial distribution of a single ion species while time-varying RF and DC voltages are applied to said quadrupole;

applying an exponentially ramped oscillatory (RF) voltage and an exponentially ramped direct current (DC) voltage to said quadrupole, wherein said RF and DC voltages are maintained in constant proportion to each other during the progression of ramping so as to selectively transmit to the distal end of said quadrupole an abundance of ions to be measured within a range of mass-to-charge values (m/z's) determined by the amplitudes of said applied RF and DC voltages;

acquiring temporal or both temporal and spatial measurements of the abundance of ions from the distal end of said quadrupole;

reconstructing a mass spectrum by deconvolving said reference signal from the acquired ion measurements, thus providing estimates of ion abundance at regular time intervals;

transforming the time points where estimates were provided into mass-to-charge ratios, thereby forming a sampled mass spectrum; and reconstructing a list of distinct m/z values and estimated intensities from the deconvolved mass spectrum.

2. The method of claim 1, wherein said computing step further comprises: generating a shifted autocorrelation vector from said reference signal.

3. The method of claim 1, wherein said computing step further comprises: constructing a matrix form of said raw data from using said reference signal.

4. The method of claim 1, where said matrix form is analyzed using Fourier Transform Mass Spectrometry (FTMS).

5. The mass spectrometer method of claim 1, further comprising: providing an increased sensitivity from about 10 up to about 200 times by opening the stability boundaries defined by Mathieu (a, q) values.

6. The mass spectrometer method of claim 1, wherein the step of applying said amplitudes of the oscillatory and DC voltages further comprises: selecting said voltages to set an m/z range of the transmitted ions of between 1 and 300 AMU.

7. The mass spectrometer method of claim 1, wherein the step of applying said amplitudes of the oscillatory and DC voltages further comprises: selecting said voltages to set an m/z range of the transmitted ions of greater than 300 AMU.

8. The mass spectrometer method of claim 1, wherein said reconstructing steps further comprises: mathematical deconvolution in the time domain, wherein the resultant values on the time axis are transformed to said distinct m/z values by exponentiation.

9. The mass spectrometer method of claim 8, wherein said mathematical deconvolution includes Fast Fourier transforms.

10. The mass spectrometer method of claim 1, wherein said method further comprises calibrating a coupled instrument that controls said ramped oscillatory (RF) voltage and said exponentially applied direct current (DC) voltage so that a desired scan line passes through the origin of a stability region.

11. The mass spectrometer method of claim 1, wherein the step of measuring a reference signal further comprises: converting said reference signal for a known m/z value into a family of reference signals for a range of m/z values so as to compensate for non-idealities in the quadrupole field.

12. The mass spectrometer method of claim 1, further comprising: providing for mass delta differentiation of 100 ppm down to about 10 ppm.

* * * * *